US012376684B2

(12) United States Patent
Shih et al.

(10) Patent No.: US 12,376,684 B2
(45) Date of Patent: Aug. 5, 2025

(54) HEIGHT-ADJUSTABLE BEDSTEAD

(71) Applicant: Chuan-Hang Shih, Changhua County (TW)

(72) Inventors: Chuan-Hang Shih, Changhua County (TW); Yu-Chi Yang, Changhua County (TW)

(73) Assignee: Chuan-Hang Shih, Changhua (TW)

( * ) Notice: Subject to any disclaimer, the term of this patent is extended or adjusted under 35 U.S.C. 154(b) by 185 days.

(21) Appl. No.: 18/379,713

(22) Filed: Oct. 13, 2023

(65) Prior Publication Data

US 2025/0082106 A1 Mar. 13, 2025

(30) Foreign Application Priority Data

Sep. 11, 2023 (TW) ..... 112134536

(51) Int. Cl.
*A47C 19/12* (2006.01)
*A47C 19/02* (2006.01)
*A47C 19/04* (2006.01)

(52) U.S. Cl.
CPC ..... *A47C 19/045* (2013.01)

(58) Field of Classification Search
CPC ..... A47C 19/02; A47C 19/04; A47C 19/045; A47C 19/12
See application file for complete search history.

(56) References Cited

U.S. PATENT DOCUMENTS 5,337,428 A * 8/1994 Krauska ..... A47C 19/045 254/106
6,941,594 B1 * 9/2005 Mosley ..... A47C 19/045 5/200.1
2005/0125900 A1 * 6/2005 Bishop ..... A61G 1/0212 5/618
2005/0251915 A1 * 11/2005 Elizondo ..... A47C 19/045 5/616
2007/0039099 A1 * 2/2007 Kozlowski ..... A47C 19/045 5/236.1
2014/0359937 A1 * 12/2014 Chang ..... A47C 19/045 5/11
2016/0143447 A1 * 5/2016 Hull ..... A47C 23/005 5/202
2016/0302583 A1 * 10/2016 Oh ..... A47C 19/12
2021/0259429 A1 * 8/2021 Sun ..... A47C 19/045

* cited by examiner

*Primary Examiner* — Justin C Mikowski
*Assistant Examiner* — Ifeolu A Adeboyejo
(74) *Attorney, Agent, or Firm* — Birch, Stewart, Kolasch & Birch, LLP

(57) ABSTRACT

A height-adjustable bedstead includes a first frame having positioning grooves, a second frame having positioning holes, a positioning member having an insertion portion, a clamping portion, and a connecting portion, and a linkage assembly including pivotally connected first and second links. The first link has an end pivotally connected to the first frame, and the other end pivotally connected to one of the positioning holes by the positioning member in a way that the insertion portion passes through the one of the positioning holes and the first link, and the clamping portion and the connecting portion are hooked onto the second frame. The second link has an end pivotally connected to the second frame, and the other end pivotally connected to one of the positioning grooves by a shaft member. As a result, the height of the bedstead can be easily and quickly adjusted.

11 Claims, 7 Drawing Sheets

HEIGHT-ADJUSTABLE BEDSTEAD

BACKGROUND OF THE INVENTION

1. Field of the Invention

The present invention relates generally to a bedstead and more particularly, to a height-adjustable bedstead.

2. Description of the Related Art

Generally, the bedstead has a fixed dimension and cannot adjust its height according to the user's needs. In order to meet the diverse needs of different consumers, factories are required to make bedsteads of different heights, and dealers need to purchase bedsteads in different sizes. This increases the burden on transportation and storage. Therefore, height-adjustable bedsteads are now commercially available in the trade market. However, the structures of such bedsteads are usually complex, resulting in high manufacturing cost. Further, the commercially available height-adjustable bedsteads may be not easy to adjust by the consumers themselves, which is inconvenient to use.

SUMMARY OF THE INVENTION

The present invention has been accomplished in view of the above-noted circumstances. It is an objective of the present invention to provide a height-adjustable bedstead, which allows the user to easily and quickly adjust the height of the bedstead to meet the user's needs.

Another objective of the present invention is to provide a height-adjustable bedstead, which has less kinds of structural components to reduce manufacturing cost.

Still another objective of the present invention is to provide a height-adjustable bedstead, which can be packed in a small size to reduce transportation and storage costs.

To attain the above objectives, the present invention provides a height-adjustable bedstead comprising a first frame, a second frame, a first positioning member, and a linkage assembly. The first frame has a plurality of positioning grooves. The second frame has a plurality of second positioning holes. The first positioning member includes a first insertion portion, a first clamping portion, and a first connecting portion connected with the first insertion portion and the first clamping portion. The linkage assembly includes a first link and a second link pivotally connected to the first link. The first link has an end pivotally connected to the first frame, and the other end pivotally connected to one of the second positioning holes by the first positioning member in a way that the first insertion portion passes through the one of the second positioning holes and the first link, and the first clamping portion and the first connecting portion are hooked onto the second frame. The second link has an end pivotally connected to the second frame, and the other end pivotally connected to one of the positioning grooves by a shaft member. As a result, the user can easily and quickly adjust the height of the bedstead to meet the user's needs. Further, the bedstead is composed of less kinds of structural components, hereby reducing the manufacturing cost thereof. Moreover, the bedstead can be packed in a small volume, thereby reducing the transportation and storage costs thereof.

BRIEF DESCRIPTION OF THE DRAWINGS

The present invention will become more fully understood from the detailed description given herein below and the accompanying drawings which are given by way of illustration only, and thus are not limitative of the present invention, and wherein.

DETAILED DESCRIPTION OF THE INVENTION

Figure 1:
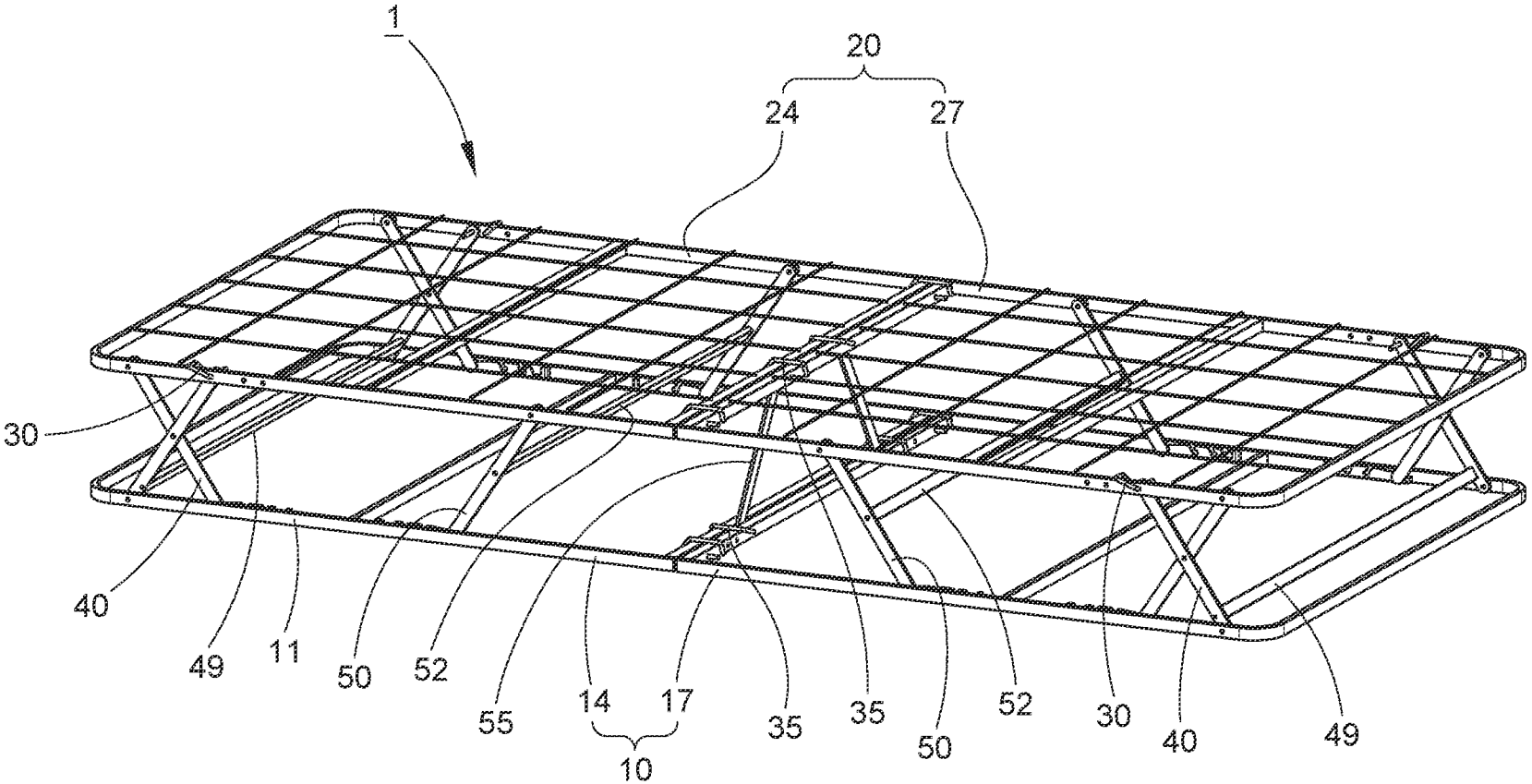
FIG. 1 is a perspective view of a height-adjustable bedstead according to a first embodiment of the present invention.
Figure 2:
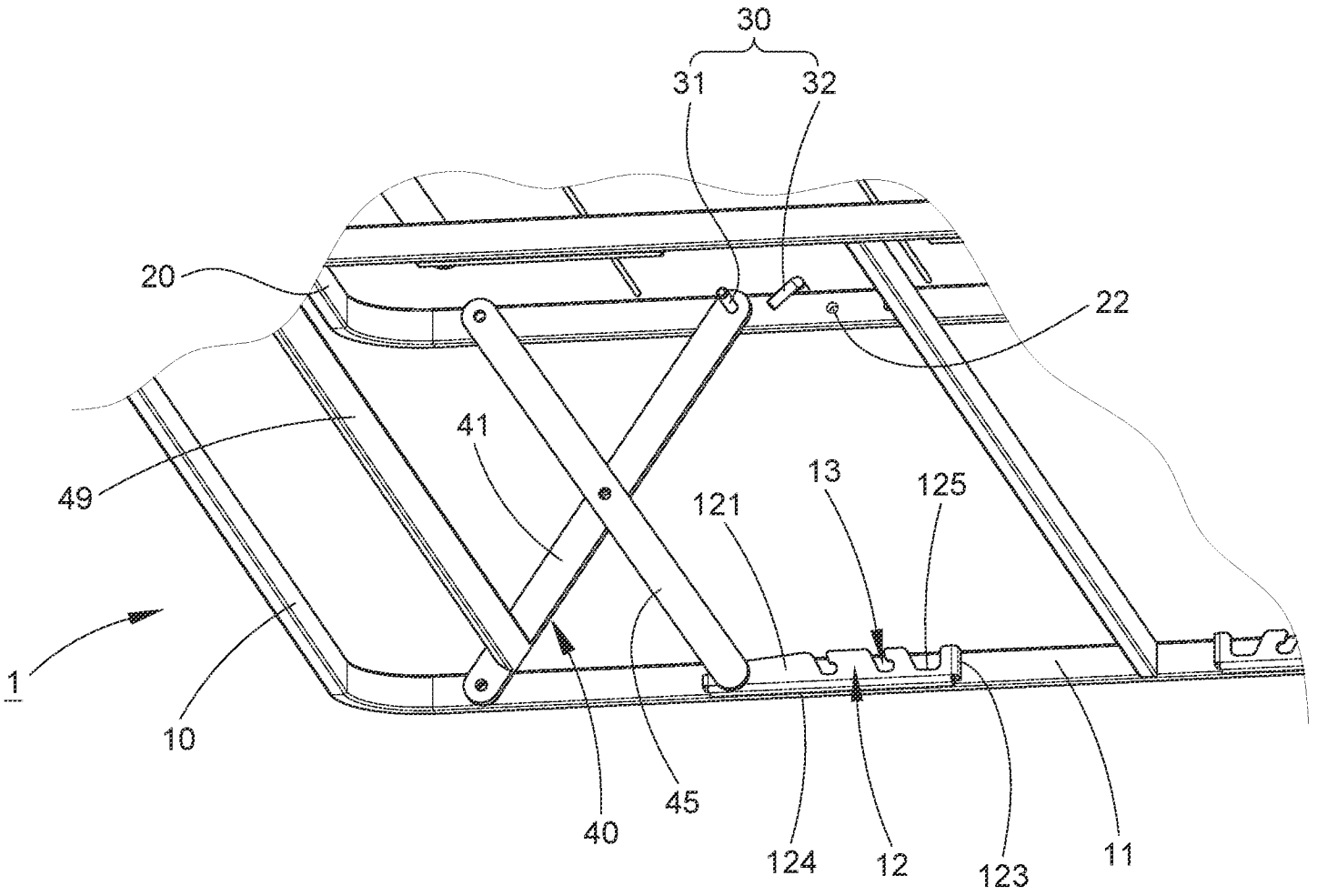
FIG. 2 is bottom perspective view of a part of the height-adjustable bedstead of the first embodiment of the present invention.
Figure 3:
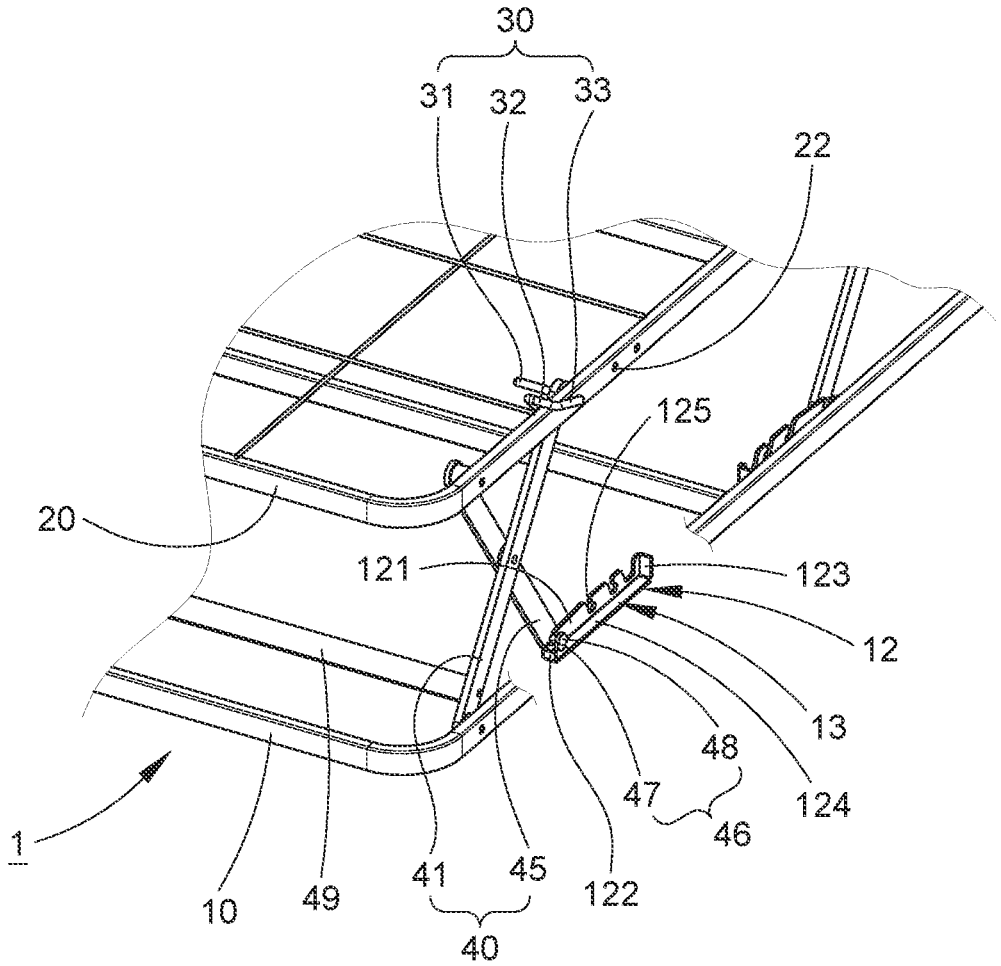
FIG. 3 is a partially cutaway perspective view of a part of the height-adjustable bedstead of the first embodiment of the present invention.
Figure 4:
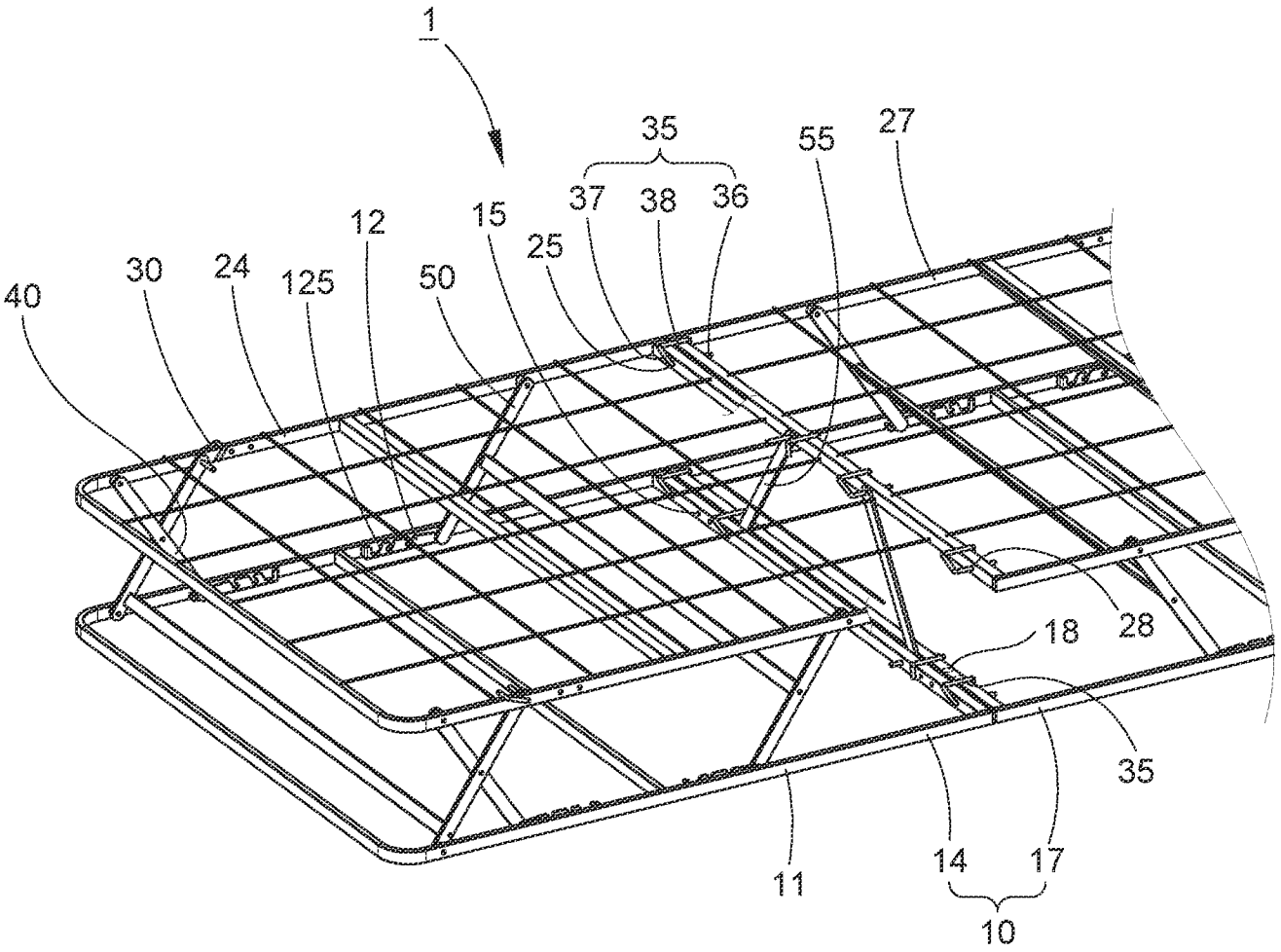
FIG. 4 is a partially cutaway perspective view of a part of the height-adjustable bedstead of the first embodiment of the present invention.

The structure and technical features of the present invention will be detailedly described hereunder by two embodiments and accompany drawings. As shown in FIGS. 1-4, a height-adjustable bedstead 1 provided in accordance with a first embodiment of the present invention is composed of a first frame 10, a second frame 20, four first positioning members 30, eight second positioning members 35, four linkage assemblies 40, four first support rods 50, and two second support rods 55. For convenient illustration, in this specification left and right sides of FIG. 1 are referred to as the front and rear sides, respectively.

The first frame 10 has a rectangular shape and is used for placement on the ground or another surface. The left and right sides of the first frame 10 each have multiple positioning grooves 125. Specifically, the first frame 10 includes a main body 11 and eight mounts 12 provided on the inner side of the main body 11. Each mount 12 has an upright plate portion 121, a front wall 122 connecting the plate portion 121 to the main body 11, a rear wall 123 connecting the plate portion 121 to the main body 11, a bottom wall 124 connecting the plate portion 121 to the main body 11, and four positioning grooves 125 formed on the plate portion 121. Each mount 12 is arranged on the inner side of the main body 11 in a way that a gap 13 is left between the plate portion 121 and the main body 11.

The second frame 20 has a rectangular shape and is positioned above the first frame 10. It is designed for supporting a mattress (not shown) thereon. The left and right sides of the second frame 20 each have multiple second positioning holes 22.

Each first positioning member 30 has a horizontally extending first insertion portion 31, an L-shaped first clamping portion 32, and a first connecting portion 33 connected with the first insertion portion 31 and the first clamping portion 32 and located at an outside of the second frame 20. The first insertion portion 31 passes through one of the second positioning holes 22, and the first clamping portion 32 is positioned on the top side of the second frame 20. The first positioning member 30 is formed by bending and processing a straight metal rod.

Each linkage assembly 40 comprises a first link 41 and a second link 45 pivotally connected to each other. The bottom end of the first link 41 is pivotally connected to the first frame 10, and the top end of the first link 41 is pivotally connected to one of the second positioning holes 22 through the first positioning member 30. The top end of the second link 45 is pivotally connected to the second frame 20, and the bottom end of the second link 45 is pivotally connected to one of the positioning grooves 125 through a shaft member 46. The first insertion portion 31 of the first positioning member 30 passes through the first link 41, while the first clamping portion 32 and the first connecting portion 33 are hooked onto the top side of the second frame 20. The shaft member 46 has a body portion 47 having an end connected with the second link 45, and the other end provided with a stop portion 48 located in the gap 13. The outer diameter of the stop portion 48 is greater than that of the body portion 47, preventing the shaft member 46 from escape out of the positioning groove 125. With the aforesaid structural features, users can choose to place the shaft member 46 in different positioning grooves 125 and insert the first insertion portion 31 of the first positioning member 30 into different second positioning holes 22. In this way, the user can easily and quickly adjust the height of the second frame 20 (i.e., the bed surface) to meet the user's needs. To enhance structural strength, a crossbar 49 can be used to connect two linkage assemblies 40. The crossbar 49 is connected to the bottom portions of two of the first links 41, but it can also be connected to the top portions of the first links 41 in another embodiment. In still another embodiment, the crossbar 49 can also connect two second links 45.

To enhance support strength to the second frame 20, the first support rods 50 may be appropriately provided at suitable positions. Each first support rod 50 is pivotally connected at its top end to the second frame 20 and pivotally mounted at its bottom end through the shaft member 46 in one of the positioning grooves 125. In this way, the first support rods 50 can support the second frame 20 at different heights. To strengthen structural strength, a connecting rod 52 may be used to link two first support rods 50.

In order to reduce packaging volume and lower transportation and storage costs, the first frame 10 may be designed to be composed of a first front frame 14, and a first rear frame 17 that can be assembled with and dismantled from the first front frame 14. The rear side of the first front frame 14 is equipped with multiple first front holes 15, and the front side of the first rear frame 17 is equipped with multiple first rear holes 18 aligned one by one with the first front holes 15, respectively. The first front frame 14 and the first rear frame 17 are combined with each other by using the second positioning members 35. The second positioning member 35 has a horizontally extending second insertion portion 36, an L-shaped second clamping portion 37, and a second connecting portion 38 connected with the second insertion portion 36 and the second clamping portion 37. The second insertion portion 36 passes through associated, paired first front hole 15 and first rear hole 18 in such a way that the rear side of the first front frame 14 and the front side of the first rear frame 17 are clamped by the second clamping portion 37 and the second connecting portion 38. This allows the first front frame 14 and the first rear frame 17 to be combined together.

Additionally, the second frame 20 may also be designed to be composed of a second front frame 24 and a second rear frame 27 that can be assembled with and dismantled from the second front frame 24. The rear side of the second front frame 24 is equipped with multiple second front holes 25, and the front side of the second rear frame 27 is equipped with multiple second rear holes 28 aligned one by one with the second front holes 25, respectively. By using the second positioning members 35, the second front frame 24 and the second rear frame 27 can be combined with each other, thereby further reducing the packaging volume to lower transportation and storage costs.

To enhance support strength to the second frame 20, the second support rods 55 may be appropriately provided at suitable positions. The bottom end of each second support rod 55 is positioned between the first front frame 14 and the first rear frame 17 and is penetrate therethrough by the second insertion portion 36 of a second positioning member 35. The top end of the second support rod 55 is positioned between the second front frame 24 and the second rear frame 27 and is penetrated therethrough by the second insertion portion 36 of a second positioning member 35. When the bottom ends of these second support rods 55 are pivotally connected through the second positioning members 35 to different first front holes 15 and first rear holes 18, the second frame 20 can be supported at different heights.

With the above-mentioned structural design, the height-adjustable bedstead 1 provided by the present invention allows users to easily and quickly adjust the bed surface height to meet their needs. The structures of the first positioning member 30 and the second positioning member 35 may be made similar or even identical. The structures of the first link 41 and the second link 45 of the linkage assembly 40, the first support rod 50, and the second support rod 55 may also be made as the same. This standardization simplifies the components, reducing manufacturing costs. Additionally, both the first frame 10 and the second frame 20 can be disassembled into front and rear parts to reduce packaging volume, lowering transportation and storage costs. As such, the objectives of the present invention are achieved.

Figure 5:
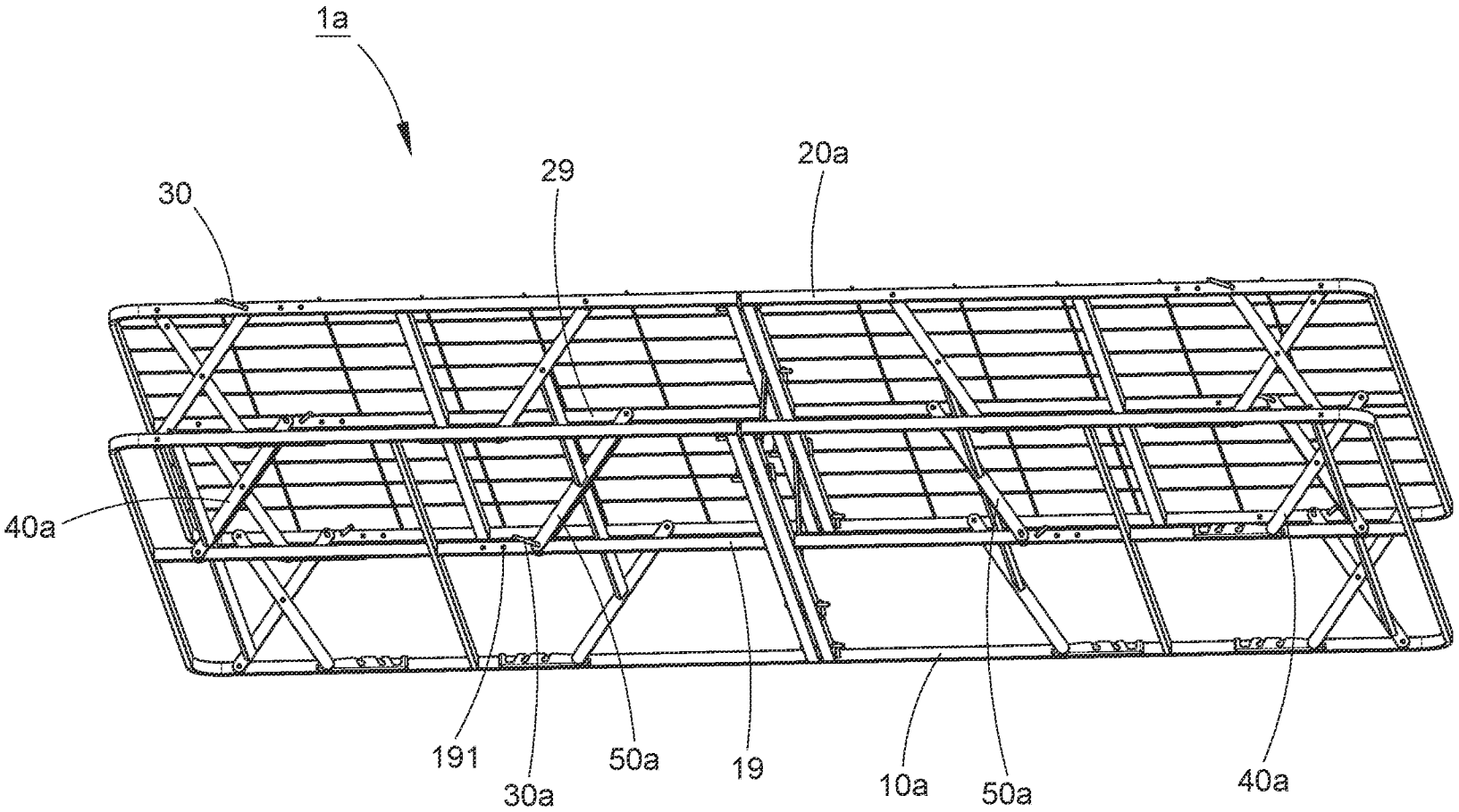
FIG. 5 is a perspective view of a height-adjustable bedstead according to a second embodiment of the present invention.
Figure 6:
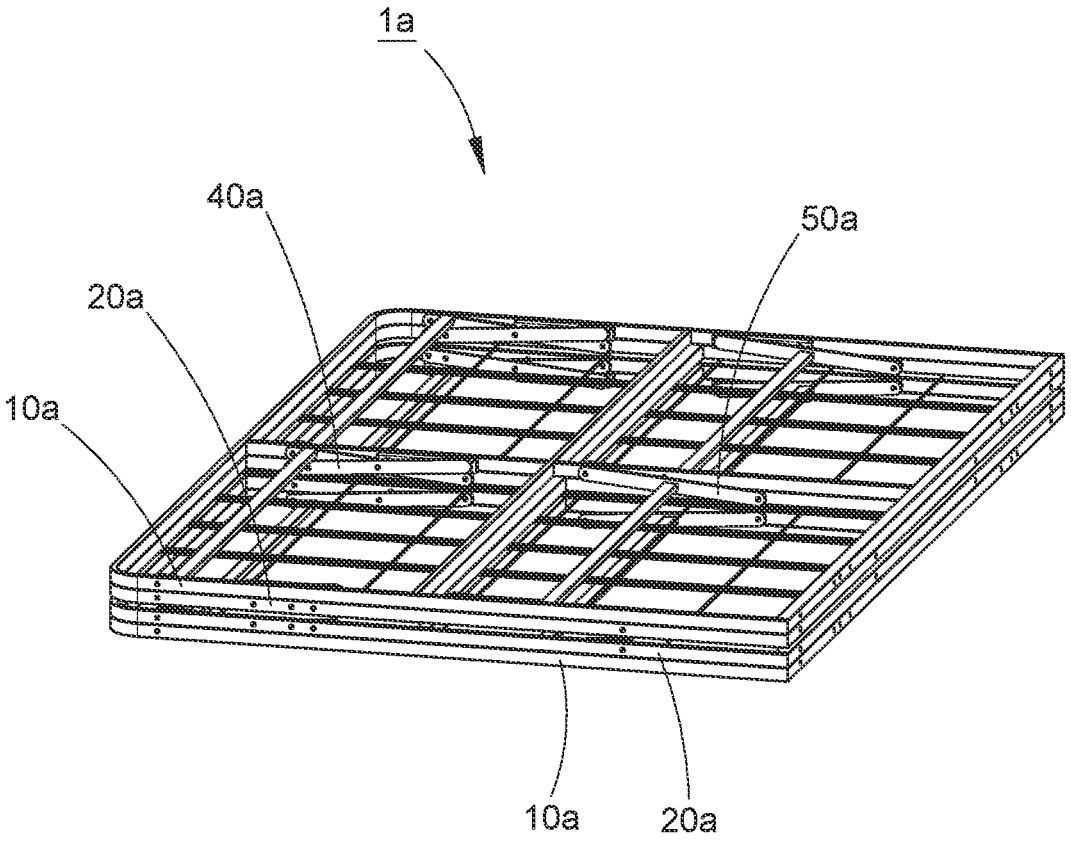
FIG. 6 is a perspective view of the height-adjustable bedstead of the second embodiment of the present invention, showing the bedstead is dismantled and folded.
Figure 7:
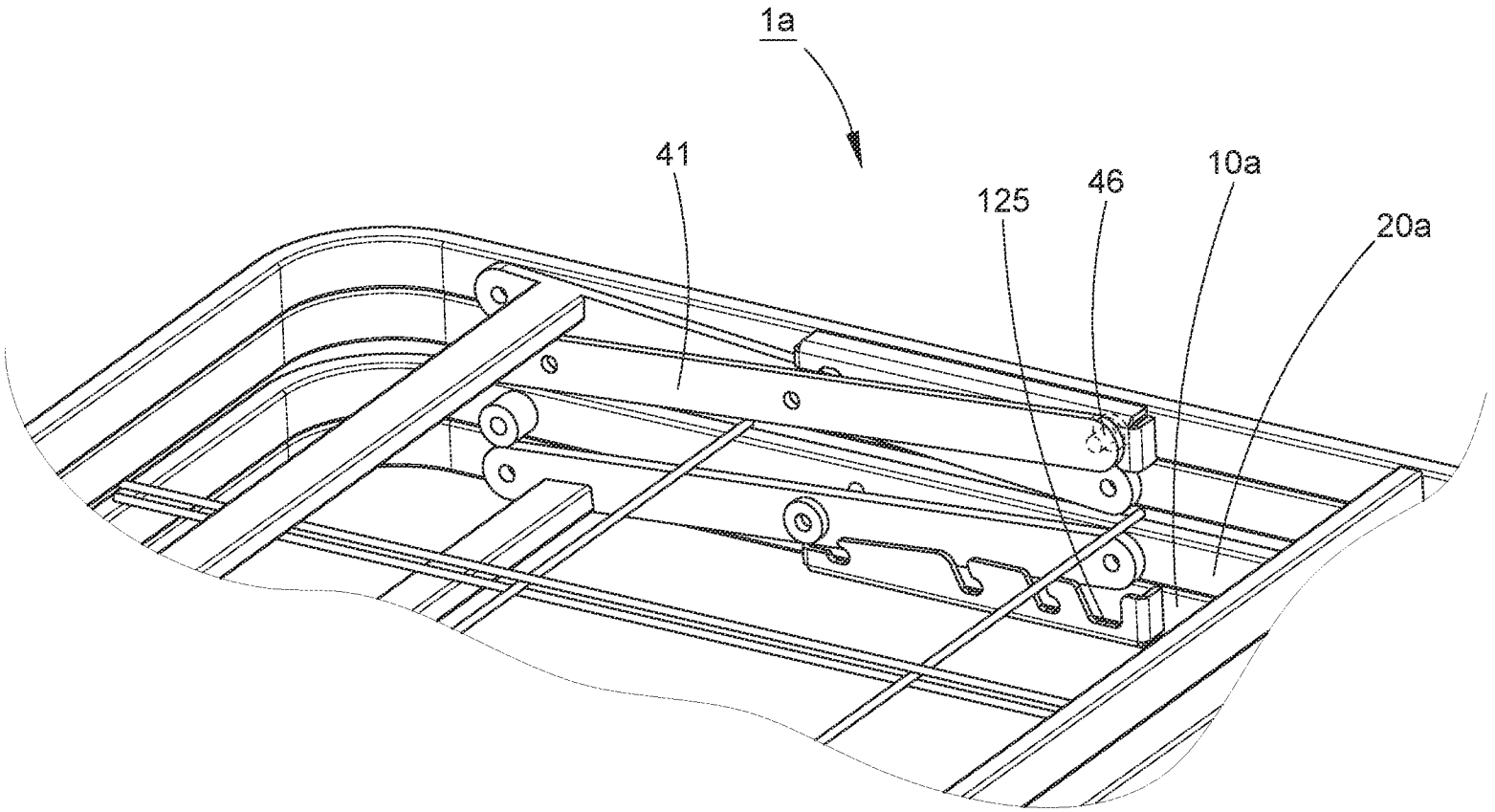
FIG. 7 is an enlarged view a part of FIG. 6.

FIGS. 5-7 show a height-adjustable bedstead 1*a* provided in accordance with a second preferred embodiment of the present invention, which is wider than the bedstead 1 of the first embodiment. Therefore, a first longitudinal bar 19 is added to the middle of the first frame 10*a*, and a second longitudinal bar 29 is added to the middle of the second frame 20*a*. Two linkage assemblies 40*a* and two first support rods 50*a* are added at relative positions. The first frame 10*a* has multiple first positioning holes 191, and the top end of the first support rod 50*a* is pivotally connected to the second frame 20*a*, while the bottom end of the first support rod 50*a* is pivotally connected through a first positioning member 30*a* in one of the first positioning holes 191. This allows the second frame 20*a* to be supported at different heights.

Additionally, as shown in FIG. 7, when the first positioning members 30, 30*a* are removed, and the shaft member 46 is positioned in the rightmost positioning groove 125, the gap 13 precisely accommodates a portion of the first link 41. This allows the first frame 10*a* to be abutted against the second frame 20*a*, thereby reducing the height of the bed frame 1*a* to its lowest. In this way, during packaging, the volume can be minimized to the greatest extent, as shown in FIG. 6, thereby reducing transportation and storage costs.

Based on the technical features of the present invention, various modifications to the bedstead 1 may be made. For example, the positioning groove 125 can be integrally formed on the first frame 10, such that the mounts 12 may be omitted. The shaft member 46 may be designed without having a stop portion 48. The first frame 10 and the second frame 20 can be interchangeably positioned up and down. The positioning grooves 125 may be located on the second frame 20, while the second positioning holes 22 may be located on the first frame 10. Such variations are not to be regarded as a departure from the spirit and scope of the invention, and all such modifications as would be obvious to one skilled in the art are intended to be included within the scope of the following claims.

What is claimed is:

1. A height-adjustable bedstead, comprising:

a first frame having a plurality of positioning grooves;

a second frame having a plurality of second positioning holes;

a first positioning member having a first insertion portion, a first clamping portion, and a first connecting portion connected with the first insertion portion and the first clamping portion; and a linkage assembly including a first link and a second link pivotally connected to the first link;

wherein the first link has an end fixedly pivotally connected to the first frame, and the other end pivotally connected to one of the second positioning holes by the first positioning member in a way that the first insertion portion passes through the one of the second positioning holes and the first link, and the first clamping portion and the first connecting portion are hooked onto the second frame; and wherein the second link has an end fixedly pivotally connected to the second frame, and the other end pivotally connected to one of the positioning grooves by a shaft member.

2. The height-adjustable bedstead as claimed in claim 1, wherein the shaft member comprises a body portion having an end connected with the second link, and the other end provided with a stop portion.

3. The height-adjustable bedstead as claimed in claim 2, comprising a plurality of said linkage assemblies, and a crossbar connected between two of said linkage assemblies.

4. The height-adjustable bedstead as claimed in claim 2, wherein the first frame comprises a main body and at least one mount disposed on an inner side of the main body; the mount comprises a plate portion provided with the positioning grooves for the body portion of the shaft member to extend therethrough; the mount is arranged in a way that a gap is left between the plate portion and the main body to accommodate the stop portion of the shaft member.

5. The height-adjustable bedstead as claimed in claim 1, further comprising a first support rod having an end pivotally connected to the second frame, and the other end pivotally connected to one of the positioning grooves.

6. The height-adjustable bedstead as claimed in claim 5, comprising a plurality of said first support rods, and a connecting rod connected between two of said first support rods.

7. The height-adjustable bedstead as claimed in claim 1, further comprising a first support rod; wherein the first frame comprises a plurality of first positioning holes; the first support rod has an end pivotally connected to the second frame, and the other end pivotally connected to one of the first positioning holes.

8. The height-adjustable bedstead as claimed in claim 7, comprising a plurality of said first support rods, and a connecting rod connected between two of said first support rods.

9. The height-adjustable bedstead as claimed in claim 1, further comprising a plurality of second positioning members; wherein the second positioning member comprises a second insertion portion, a second clamping portion, and a second connecting portion connected with the second insertion portion and the second clamping portion; the first frame comprises a first front frame having a plurality of first front holes, and a first rear frame having a plurality of first rear holes aligned with the first front holes, respectively; the second insertion portion of one of the second positioning members passes through associated said first front hole and said first rear hole in a way that the first front frame and the first rear frame are clamped by the second clamping portion and the second connecting portion of the one of the second positioning members.

10. The height-adjustable bedstead as claimed in claim 9, wherein the second frame comprises a second front frame having a plurality of second front holes, and a second rear frame having a plurality of second rear holes aligned with the second front holes, respectively; the second insertion portion of one of the second positioning members passes through associated said second front hole and said second rear hole in a way that the second front frame and the second rear frame are clamped by the second clamping portion and the second connecting portion of the one of the second positioning members.

11. The height-adjustable bedstead as claimed in claim 10, further comprising a second support rod having an end located between the first front frame and the first rear frame and penetrated by the second insertion portion of one of the second positioning members, and the other end located between the second front frame and the second rear frame and penetrated by the second insertion portion of another one of the second positioning members.

* * * * *